US012727651B2

(12) United States Patent
Di Piazza

(10) Patent No.: US 12,727,651 B2
(45) **Date of Patent: *Sep. 8, 2026**

(54) MANUFACTURE OF A BRACELET STRAND

(71) Applicant: ROLEX SA, Geneva (CH)

(72) Inventor: Philippe Di Piazza, Geneva (CH)

(73) Assignee: ROLEX SA, Geneva (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/510,335

(22) Filed: Nov. 15, 2023

(65) Prior Publication Data

US 2024/0164494 A1 May 23, 2024

(30) Foreign Application Priority Data

Nov. 17, 2022 (EP) ..... 22207937

(51) Int. Cl.
*A44C 27/00* (2006.01)
*A44C 5/00* (2006.01)
*A44C 5/14* (2006.01)

(52) U.S. Cl.
CPC ..... *A44C 27/002* (2013.01); *A44C 5/0053* (2013.01); *A44C 5/14* (2013.01)

(58) Field of Classification Search
CPC ..... A44C 5/14; A44C 5/0053; A44C 5/00; A44C 5/0084; A44C 17/02; A44C 17/04; A44C 27/002; A44C 5/12; A44C 27/001; G04B 37/1486
USPC ..... 63/3, 11
See application file for complete search history.

(56) References Cited

U.S. PATENT DOCUMENTS 254,156 A * 2/1882 Ricker ..... A01K 27/007 D30/152
2,191,314 A * 2/1940 Davis ..... A44C 5/0053 63/11
2,702,683 A * 2/1955 Cosser ..... B67D 7/38 220/744
4,052,863 A 10/1977 Poll
4,353,765 A 10/1982 Covi
(Continued)

FOREIGN PATENT DOCUMENTS

CH 703482 A2 1/2012
EP 3178344 A1 6/2017
(Continued)

OTHER PUBLICATIONS

European Search Report and Written Opinion dated Apr. 21, 2023 in priority application No. EP22207937.8; with English machine translation (total 10 pages).
(Continued)

*Primary Examiner* — Jack W Lavinder
(74) *Attorney, Agent, or Firm* — Seckel IP, PLLC

(57) ABSTRACT

The process for manufacturing a bracelet strand includes positioning an insert (15) within a cavity (21) of a manufacturing mould (20); positioning at least one fastening element (12) on the insert (15) using at least one guide element (35); filling the manufacturing mould (20) with a material so as to overmould, i.e. at least partially envelop and set, the insert (15) and the at least one fastening element (12) in the material; removing the bracelet strand (10) from the manufacturing mould (20), this bracelet strand (10) being at least partly formed by the material, the insert (15), and the at least one fastening element (12).

23 Claims, 4 Drawing Sheets

(56) References Cited

U.S. PATENT DOCUMENTS

| | | | | |
|---|---|---|---|---|
| 4,936,116 | A | 6/1990 | Poll | |
| 5,338,591 | A | 8/1994 | Poll | |
| 6,457,328 | B1 * | 10/2002 | Tsai | G02B 6/0006 63/3 |
| 6,491,424 | B1 * | 12/2002 | Tardy | G04B 39/00 368/283 |
| 7,691,221 | B2 * | 4/2010 | Swarovski | B44C 5/00 428/542.2 |
| 10,736,389 | B2 * | 8/2020 | Bourban | C25D 7/005 |
| 2009/0059735 | A1 * | 3/2009 | Burton | A44C 5/12 368/281 |
| 2013/0091620 | A1 * | 4/2013 | Randolph | A43B 3/242 2/244 |
| 2014/0090418 | A1 * | 4/2014 | Mihalyo | A44C 5/0084 63/3 |
| 2017/0364646 | A1 | 12/2017 | Chalissery et al. | |
| 2020/0301366 | A1 | 9/2020 | Boaron et al. | |

FOREIGN PATENT DOCUMENTS

| | | | |
|---|---|---|---|
| EP | 3712716 | A1 | 9/2020 |
| GB | 630364 | A | 10/1949 |
| KR | 101195477 | B1 | 10/2012 |

OTHER PUBLICATIONS

European Search Report and Written Opinion dated Mar. 28, 2023 in priority application No. EP22207941.0 of co-pending U.S. Appl. No. 18/510,259; with English machine translation (total 16 pages).
Office Action dated Aug. 26, 2025 in co-pending U.S. Appl. No. 18/510,259; with PTO892; without returned SB08 (total 13 pages).
Office Action dated Feb. 2, 2026 in co-pending U.S. Appl. No. 18/510,259; with PTO892; without returned SB08 (total 18 pages) 1 (note: U.S. Pat. No. 5338591, Ref.A in the Office Action, is not listed in this Office Action since it is already of record in this application).

* cited by examiner

MANUFACTURE OF A BRACELET STRAND

CROSS-REFERENCE TO RELATED APPLICATION

This application claims priority of European patent application No. EP22207937.8 filed Nov. 17, 2022, the content of which is hereby incorporated by reference herein in its entirety.

INTRODUCTION

The present invention relates to a process for manufacturing a bracelet strand. The invention also relates to a bracelet strand per se, and also to a timepiece comprising such a bracelet strand.

BACKGROUND ART

In the field of watch- or clock-making, it is sometimes desirable to add ornamental elements to a bracelet strand. More generally, it may be desired to add various elements and/or functionalities to a bracelet strand.

To produce such an addition, it is necessary to achieve all or some of the following objectives:

- a satisfactory result in terms of aesthetics and comfort when worn;
- a result with satisfactory mechanical properties;
- a reliable and robust result;
- a result that is easy to obtain, in a repeatable manner.

Thus, the general aim of the present invention is to propose a solution for manufacturing a bracelet strand comprising at least one complementary element and/or one additional functionality, while at the same time having an aesthetically attractive result, with satisfactory mechanical properties, which is reliable and robust, and easy to obtain, and in a repeatable manner.

SUMMARY OF THE INVENTION

To this end, the invention is based on a process for manufacturing a bracelet strand, wherein it comprises the following steps:

- positioning an insert within a cavity of a manufacturing mould;
- positioning at least one fastening element on said insert by means of at least one guide element;
- filling the manufacturing mould with a material so as to overmould, i.e. at least partially envelop and set, the insert and the at least one fastening element in the material;
- removing the bracelet strand from the manufacturing mould, this bracelet strand being at least partly formed by said material, the insert, and the at least one fastening element.

The invention also relates to a bracelet strand based on a material, wherein it comprises an insert, and at least one fastening element, resting on the insert or being set on the insert, which are overmoulded by said material, i.e. enveloped at least partially and set by the material.

The invention is more precisely defined by the claims.

BRIEF DESCRIPTION OF THE DRAWINGS

These objects, features and advantages of the present invention will be presented in detail in the following description of particular embodiments given on a non-limiting basis in relation to the accompanying figures, in which.

DETAILED DESCRIPTION OF PARTICULAR EMBODIMENTS

Throughout the text hereinbelow, the adjectives "upper" and "lower" will be used to refer to the future positioning of the bracelet strand. For example, in the case of a bracelet strand, the adjective "lower" denotes the orientation intended to be on the wrist side of a wearer and the adjective "upper" denotes the opposite orientation.

Figure 1:
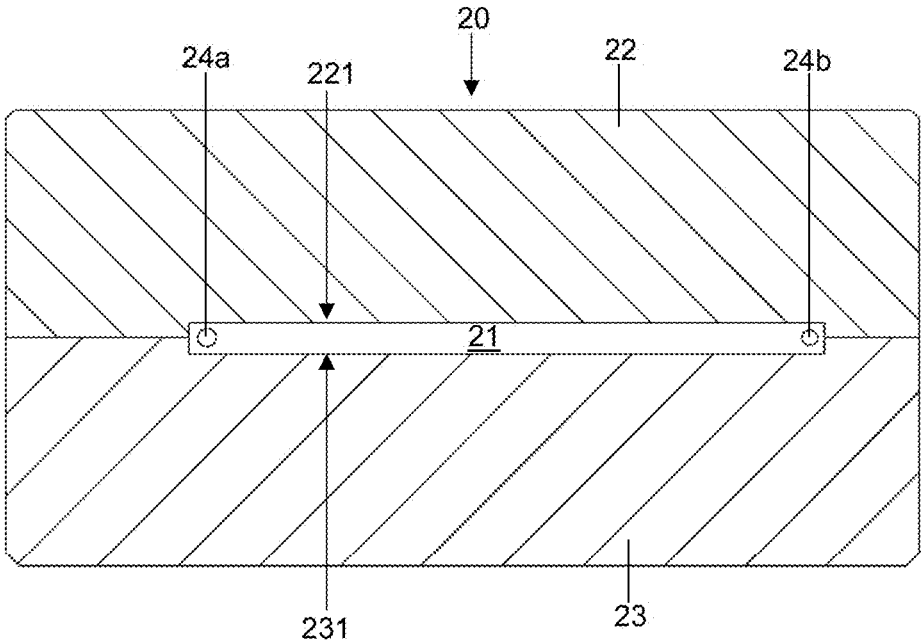
FIG. 1 represents a first cross-sectional view of a mould for manufacturing a bracelet strand according to an embodiment of the invention.
Figure 2:
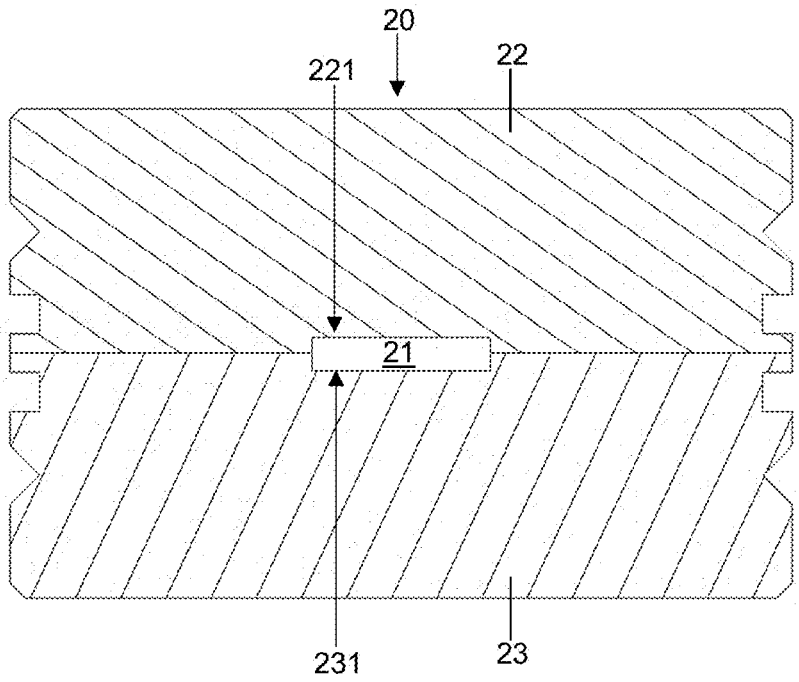
FIG. 2 represents a second cross-sectional view of the mould for manufacturing a bracelet strand according to the embodiment of the invention.

FIGS. 1 and 2 represent a mould 20 used for performing the invention. Such a mould 20 comprises a cavity 21 delimited by two half-moulds 22, 23 which are movable relative to each other. These two half-moulds 22, 23 respectively comprise walls 221, 231 which form a delimitation of the cavity 21 of the mould 20, respectively the upper and lower planes of this cavity 21. FIGS. 1 and 2 more precisely represent cross sections of the mould 20 at the level of cavity 21, respectively along two perpendicular median planes. The cavity 21 has a substantially flat and rectangular shape, which corresponds to the shape of the bracelet strand to be manufactured, and said two cutting planes in FIGS. 1 and 2 are median planes, respectively longitudinal, i.e. oriented along the length of the cavity 21, perpendicular to a plane formed by a wall 221, 231 of this cavity, and transverse, i.e. oriented perpendicular to the longitudinal direction of the cavity 21, perpendicular to a plane formed by a wall 221, 231 of this cavity.

The two half-moulds 22, 23 respectively comprise the walls 221, 231 which are substantially flat and parallel in FIGS. 1 and 2. Alternatively, these walls 221, 231 may be curved. Their shape corresponds to the shape of the upper and lower surfaces of the bracelet strand to be manufactured. Optional housing portions 24*a*, 24*b* are positioned within the mould cavity 21. Their function will be specified later.

The concept of the invention consists in positioning an insert and a fastening element within such a manufacturing mould, before filling the manufacturing mould with a material, so as to overmould the insert and the fastening element, i.e. to envelop them at least partially in said material, in a manner sufficient to set them in the material. This material corresponds to the main material of the bracelet strand and/or to the material that is visible from the upper surface and/or the lower surface of the bracelet strand, and will be referred to hereinbelow as the "material of the bracelet strand" or more simply as the "material".

The mould may be filled by any means, notably by injection or compression moulding. In the case of an injection moulding process, the material is, for example, injected at a given pressure (typically between 80 bar and 150 bar, or even between 80 bar and 90 bar) into the cavity 21, while the mould is already closed and has a given temperature (typically between 150° C. and 250° C., or even between 150° C. and 200° C.). In the case of a compression moulding process, a preform or blank of strand material is positioned on the wall 231 before the mould is closed, and is then compressed at a given temperature (typically between 150° C. and 250° C., or even between 150° C. and 200° C.). In all cases, this material is positioned at least partly around one or more fastening elements, so as to envelop them and set them in the bracelet strand: this material thus overmoulds the insert and the fastening element(s).

Advantageously, the material is an elastomer or elastomer-based material, i.e. a material comprising at least 50% by weight of elastomer. In particular, the elastomer material may be a fluoro elastomer (FKM, FFKM or FEPM), or a natural rubber (NR) or synthetic rubber (SBR, HNBR, EPDM), or a vinyl methyl silicone (VMQ) or a fluoro silicone (FVMQ). More generally, the component material may be a polymer. It may notably be a thermoplastic or thermosetting polymer.

Figure 3:
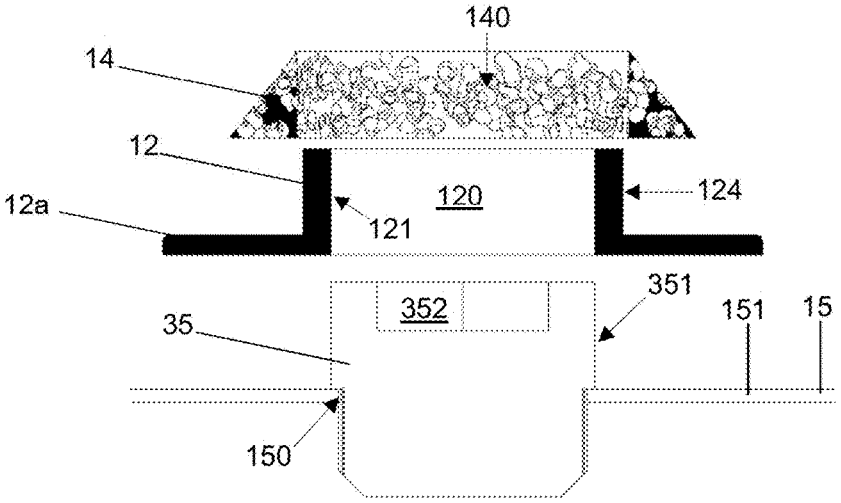
FIGS. 3 to 5 represent schematic cross-sectional views of steps of a process for manufacturing a bracelet strand according to a first embodiment of the invention.
Figure 4:
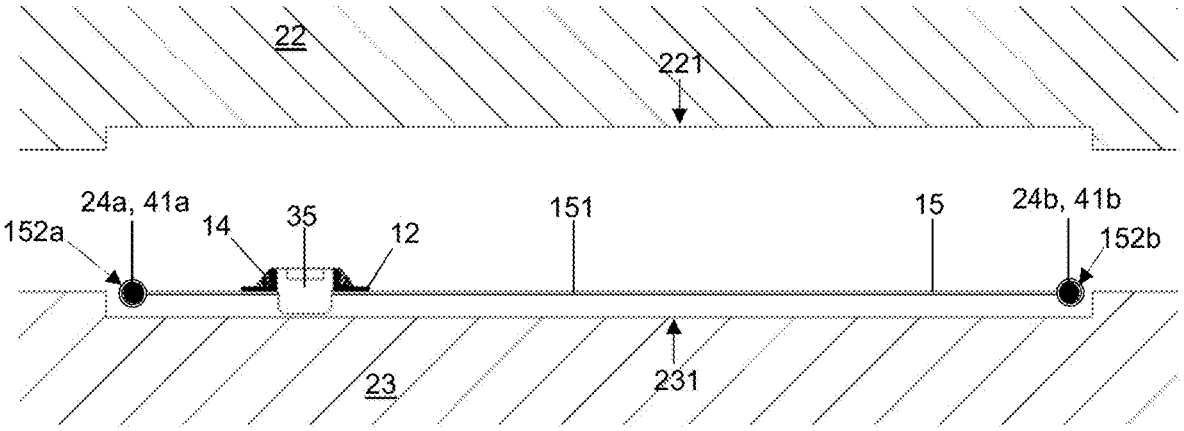
Figure 5:
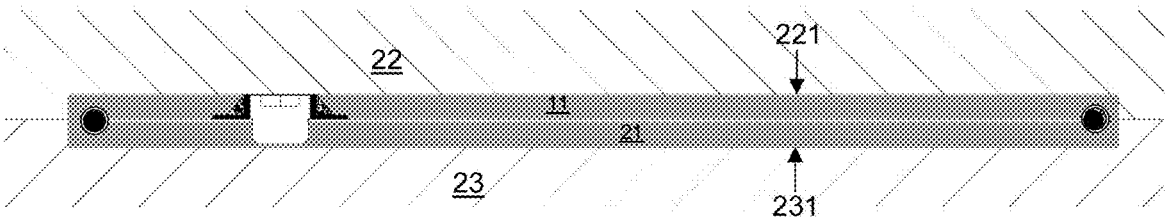

FIGS. 3 to 5 illustrate a process for manufacturing a bracelet strand according to a first embodiment of the invention.

FIGS. 3 and 4 illustrate a first step in the process according to the first embodiment, which consists in positioning at least one fastening element 12 within the manufacturing mould 20 by means of at least one guide element 35 arranged on an insert 15. In the example shown, a single fastening element 12 is positioned, but, as a variant, several fastening elements could be positioned, each by means of a guide element 35. There are thus as many guide elements 35 as there are fastening elements 12.

In this first embodiment, each guide element 35 is a projecting element, fixed or integrally formed with the insert 15.

As is seen in FIGS. 3 and 4, the insert 15 according to a particular embodiment is in the form of a blade 151, which may advantageously be a metal blade 151, in particular a superelastic metal alloy blade 151. This blade comprises two setting devices in the shape of two loops 152*a*, 152*b* arranged, respectively, at each of its longitudinal ends.

This insert 15 serves as a support for the guide element(s) 35 provided for positioning the fastening element(s) 12.

As is seen more particularly in FIG. 3, a guide element 35 may be in the form of a screw screwed into a through aperture 150 in the blade 151. The periphery of the screw head constitutes here a first guide surface 351, intended to cooperate with a second guide surface 121 arranged on the fastening element 12.

In this first embodiment, each guide element 35 is in the form of a cylindrical stud which projects from the upper surface of the insert 15, thus extending into the cavity 21 of the mould 20. The contour of the stud at least partially forms the first guide surface 351.

The fastening element 12 is itself in the form of a ring with an aperture 120 which is intended to receive the stud forming the guide element 35. The inner surface of the ring, delimiting the aperture 120, forms the second guide surface 121. In this embodiment, the fastening element 12 extends substantially over the entire height of the cavity 21 of the mould 20 above the upper surface of the insert 15 (apart from the assembly clearance). Advantageously, the fastening element 12 is more precisely a seating ring. It thus comprises a first upper cylindrical portion, defining a central aperture 120, terminating at its base in a disc or a second cylindrical portion arranged around the first cylindrical portion, which defines a seating 12*a*.

Optionally, a hooking element 14 is associated with the fastening element 12. In particular, this hooking element is in the form of a ring with an aperture 140, the diameter of which is intended for positioning around the fastening element 12, according to a step of the process according to the first embodiment more particularly represented by FIG. 3. Furthermore, this hooking element 14 advantageously comprises a honeycomb structure so that the material 11 of the bracelet strand can be inserted and anchored within this hooking element 14, and also between the fastening element 12 and the hooking element 14. The term "honeycomb structure" means a structure comprising a multitude of intersecting through apertures. Advantageously, the hooking element 14 may be in the form of a metal foam. Preferentially, the hooking element 14 is conical or frustoconical in shape, with its volume increasing towards the interior of the thickness of the bracelet strand, i.e. in a direction going from the upper surface towards the lower surface of the bracelet strand. The advantage of such a shape is that it minimizes the visibility of the hooking element 14 from the upper surface of the bracelet strand. Moreover, such a progressive shape enables the material 11 to bind better. Such a geometry of the fastening element 12, combined with such a hooking element 14, allows the phenomenon of yawning around the fastening element 12 to be very substantially minimized, or even eliminated, i.e. deformation of the aperture of the strand around the fastening element 12 allowing an undesirable gap to appear. It should be noted that, as a variant, such a hooking element 14 may be combined with all the fastening elements of any implementation variant according to the invention. It remains optional in all cases.

As shown in FIG. 3, the fastening element 12 is associated with a hooking element 14, this assembly then being mounted on a guide element 35, once the latter has been positioned on an insert 15, outside or in the cavity 21 of a mould 20, as shown in FIG. 4.

The process then comprises a second step, represented by FIG. 5, consisting in filling the manufacturing mould 20 with a material 11 so as to overmould the assembly comprising the insert and the at least one fastening element 12 in the material 11, so as to at least partially envelop it and to set it into the material, and thus into the resulting bracelet strand.

Figure 7:
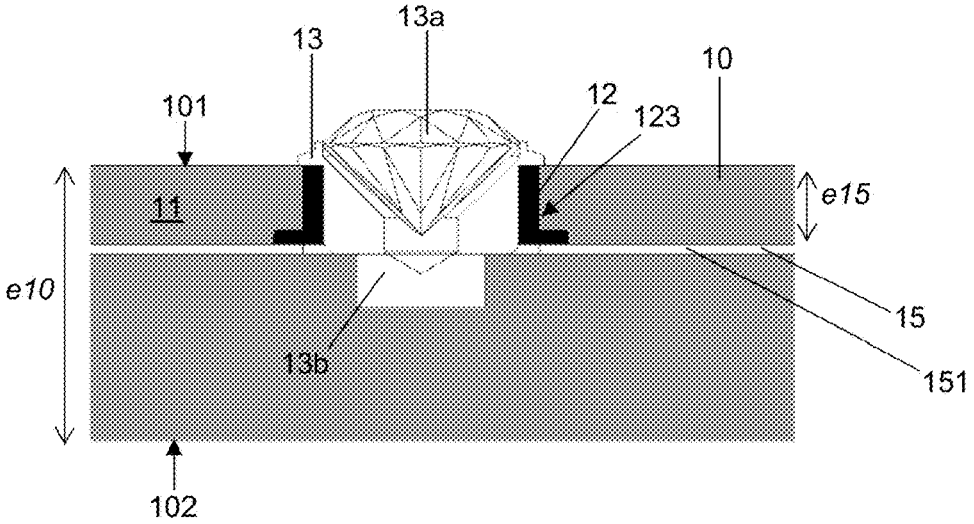
FIG. 7 represents an enlarged partial cross-sectional view of a bracelet strand according to a second implementation variant obtained via the process according to the first embodiment of the invention.

Advantageously, in this second step, the guide element 35 blocks any entry of material or considerably limits the entry of material into the aperture 120 of the fastening element 12. The outer contour of the fastening element 12, for its part, forms at least one binding surface 123 intended to come into contact with the material 11 injected or compressed around it (in particular in the case where there is no hooking element 14, as represented by FIG. 7).

In summary, the manufacturing process according to this first embodiment thus comprises the two first steps specified below.

The first step of the process comprises a preliminary sub-step which consists in assembling at least one guide element 35 on an insert 15. This assembling may be performed by any means, other than the screwing described previously. Thus, the guide element 35 may, as a variant, be different from a screw as represented. It should be noted that this preliminary step may also comprise mounting a hooking element 14 around the fastening element 12.

The first step of positioning at least one fastening element 12 in the manufacturing mould is thus obtained by means of this guide element 35, and by means of an insert 15, which is itself preferentially positioned within the manufacturing mould.

The first step thus comprises, for example, positioning the insert 15 on the half-mould 23 of the mould. To do this, pins 41*a*, 41*b* are provided for threading, respectively, firstly into loops 152*a*, 152*b* of the insert 15, in particular the blade 151, and secondly into portions of housings 24*a*, 24*b* formed on the half-mould 23 of the mould. Thus, the blade 151 is positioned within the cavity 21, and is kept suspended at a distance from the opposite longitudinal walls 221, 231 of the mould 20 once the mould is closed.

In summary, the process for manufacturing a bracelet strand comprises the following two sub-steps of a first step of positioning at least one fastening element 12 in a mould:

positioning an insert 15 within a cavity 21 of a manufacturing mould 20;

positioning at least one fastening element 12 on said insert 15 by means of at least one guide element 35.

These two sub-steps may be carried out successively, or in the reverse order, or substantially simultaneously.

Optionally, the first step of the process comprises, in addition to the above sub-steps, another sub-step for positioning a hooking element 14 around a fastening element 12, before or during the positioning of the latter around a guide element 35, as represented by FIG. 3. To this end, the first cylindrical portion of the fastening element 12 comprises a surface 124 for receiving the hooking element 14 at its outer periphery. Thus, the fastening element 12 is inserted within the central aperture 140 of the hooking element 14; this assembly may then be positioned on the insert 15 by means of the guide element 35, and then within the cavity 21 of the mould 20.

The manufacturing process then comprises a second step consisting in filling the manufacturing mould 20 with a material so as to overmould, i.e. at least partially envelop and set, the insert 15 and thecu at least one fastening element 12 in the material.

The process then comprises a third step, not represented, which consists in removing the bracelet strand 10 from the manufacturing mould 20. This bracelet strand 10 is thus at least partly formed by the material 11 which has filled the cavity 21 of the mould 20, the insert 15 and the at least one fastening element 12. In this demoulding step, the upper half-mould 22 is separated from the lower half-mould 23, which is fixed according to this implementation example. It should be noted that the result obtained during this demoulding step may only be a rough outline of the bracelet strand, which still requires finishing operations, such as cutting, surface treatment, etc., before obtaining the finished bracelet strand.

After removing the bracelet strand from the mould, the process comprises an intermediate step which consists in removing the at least one guide element 35 from the bracelet strand blank, notably by unscrewing according to the example illustrated. Next, an ornamental element 13 may, for example, be set within the aperture 120 of at least one fastening element 12, notably by driving. Beforehand, any undesired overspilling material 11, notably within the aperture 120, which may result from the second filling step, may be removed via a technique known to those skilled in the art, for instance cryogenic sandblasting. Furthermore, an ornamental element 13 may comprise a chaton 13*b* within which is set a stone 13*a* that is visible from the upper surface 101 of the bracelet strand.

Figure 6:
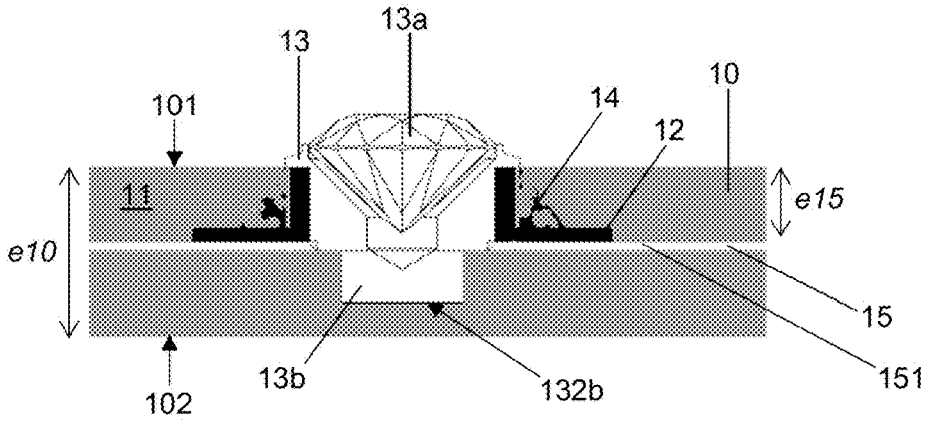
FIG. 6 represents an enlarged partial cross-sectional view of a bracelet strand according to a first implementation variant obtained via the process according to the first embodiment of the invention.

FIG. 6 thus illustrates a first variant of a bracelet strand obtained via the process according to the first embodiment. The blade 151 forming the insert 15 is positioned at the centre of the thickness e10 of the bracelet strand. In other words, the blade 151 is equidistant or substantially equidistant from the upper surface 101 and the lower surface 102 of the bracelet strand, with a distance e15 separating it from the upper surface 101 equal or substantially equal to e10/2. Thus, the blade 151 constitutes or comes close to the ply of neutral fibres of the bracelet strand when the latter is subjected to simple bending. Moreover, it should be noted that this blade 151 thus acts as a reinforcement for the bracelet strand.

FIG. 7 illustrates a second variant of the bracelet strand obtained via the process according to this first embodiment. The bracelet strand differs from that according to the first variant in that the blade 151 is positioned closer to the upper surface 101 of the bracelet strand, so as to shift the ply of neutral fibres towards this upper surface 101. This is in fact made possible by the fact that the material of the blade 151 is advantageously stiffer than the material of the bracelet strand, namely the material at least partially enveloping at least one fastening element. Thus, in this design, the thicknesses comply with the following conditions: e15<e10/2, or even e15<e10/3. To obtain the bracelet strand according to this second implementation variant, the positions of the housings 24*a*, 24*b* within the cavity 21 of the mould may be shifted so as to bring the blade 151 closer to a longitudinal wall of a half-mould of the mould 20, during the first step of the process. This second implementation variant has the advantage of minimizing traction phenomena around the fastening element 12 when the bracelet strand is bent. Specifically, tests have shown that this design allows any yawning around the fastening element 12 to be substantially limited, or even prevented, without the need to insert a hooking element 14. It is also possible to minimize the size, in particular the diameter, of the seating 12*a*, or even to dispense with the seating 12*a* of the fastening element 12. Such a design according to this second implementation variant thus also has the advantage of limiting the bulk of the elements required for fastening an ornamental element 13 to the bracelet strand, on the one hand by dispensing with the hooking element 14, and on the other hand by minimizing the size of the fastening element 12. The advantage of such a design is thus that it allows different ornamental elements to be brought closer together, and their number on the bracelet strand can thus possibly be maximized, for example for aesthetic purposes.

According to another variant embodiment which is not represented, the fastening element may be in the form of a simple cylindrical ring. As a variant, this ring may take another shape, for example which extends totally in a direction perpendicular to the upper surface 101 of the bracelet strand, and notably has a cylindrical or frustoconical shape around an axis parallel to this direction, and/or has an annular cross section.

In these embodiments, the use of a hooking element 14 is optional. In the example illustrated by FIG. 6, the material 11 is more particularly inserted into the honeycomb structure of the hooking element 14.

Moreover, in order to promote the binding of the material 11 around the fastening element(s) 12, their binding surfaces 123, which coincide with the abovementioned receiving surface 124, may be textured via a technique known to those skilled in the art, so as to make them particularly rough. Alternatively or additionally, these surfaces may be coated with a binding primer. According to the variant represented, a binding surface is formed by the outer peripheral surface of the cylindrical ring forming the fastening element 12.

Moreover, the seating 12*a* of the fastening element 12 is thus embedded in the material 11 of the bracelet strand, i.e. in the thickness of the bracelet strand, since the material 11 extends on either side of the upper and lower surfaces of said seating 12*a*, the latter being arranged on the insert 15. This embodiment variant allows the bending of the bracelet strand to be minimized locally, around the peripheral surface of the fastening element 12, notably around the first cylindrical portion of the fastening element 12, in particular at the seating 12*a* formed by the disc or the second cylindrical portion of the fastening element 12.

In these embodiments, the resulting fastening element 12 rests on the insert 15.

The conformation of the ornamental element 13, in particular of the chaton 13*b*, may be provided so that it can be actuated from the lower surface 102 of the bracelet strand 10. For example, the chaton 13*b* may comprise an actuating surface 132*b* projecting from the fastening element 12, i.e. extending deeper into the thickness of the bracelet strand than the fastening element 12, so as to present a lower surface extending parallel or substantially parallel to the lower surface 102 of the bracelet strand, and in the vicinity of this lower surface. Such a surface may, for example, cooperate with dedicated tooling so as to allow disengagement of the ornamental element. Alternatively, the ornamental element 13, in particular the chaton 13*b*, may be shaped so that it cannot be actuated once it has been assembled within the fastening element 12. By way of example, the chaton 13*b* may be embedded within the fastening element 12, as will be illustrated with reference to FIG. 10 hereinbelow.

Figure 8:
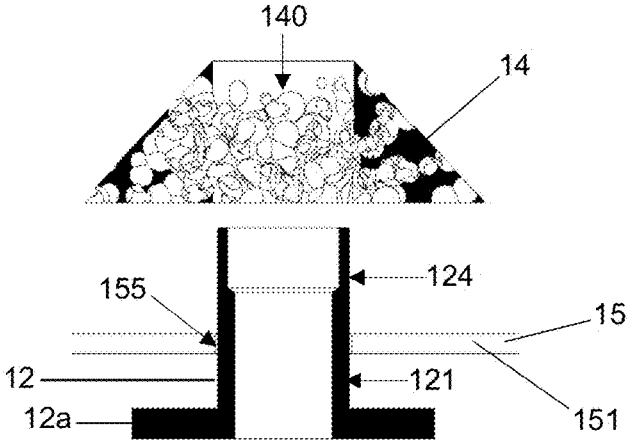
FIGS. 8 and 9 represent schematic cross-sectional views of steps of a process for manufacturing a bracelet strand according to a second embodiment of the invention.

The process according to the second embodiment constitutes an alternative to the first embodiment. The at least one fastening element 12 is positioned here on the insert 15 not by a guide element 35 previously positioned on the blade 151, but directly within an aperture 155 formed on the blade, acting as guide element 35, as represented by FIG. 8. To this end, the at least one fastening element 12 comprises a guide surface 121 intended to cooperate with the contour of the aperture 155, which thus forms a guide element 35. In particular, the at least one fastening element 12 is in the form of a ring whose outer periphery comprises the guide surface 121 which is intended to be housed in the aperture 155. In order to allow the ring to be held on the blade 151, the outer periphery of the ring also comprises a surface 124 for receiving, notably for driving, a hooking element 14 in the form of a ring. In addition, the fastening element 12 also comprises a seating 12*a* so as to allow it to be held axially on the blade 151. It should be noted that, alternatively or additionally, the insert 15 may have or comprise any other shape fulfilling the function of a guide element, for instance a projection.

Figure 9:
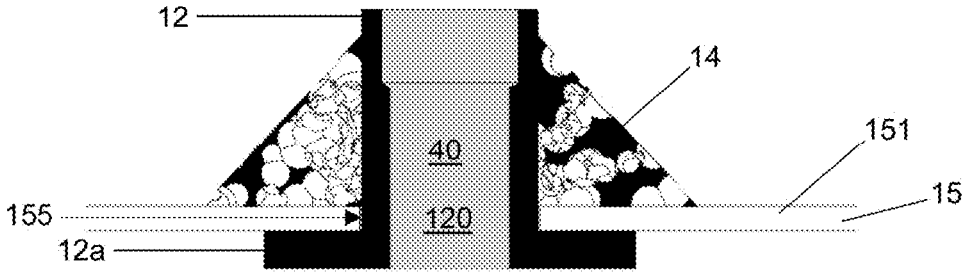

FIGS. 8 and 9 schematically illustrate the steps of the process for manufacturing a bracelet strand according to this second embodiment.

During the first step represented by FIG. 8, the fastening element 12 is assembled on an insert 15, which is in the form of a blade 151, as in the first embodiment. In this embodiment, the fastening element 12 is threaded through an aperture 155 from a lower surface of the blade 151, and a hooking element 14 is then set into the fastening element 12 from the opposite upper surface, notably by engagement around the outer surface of the fastening element 12.

The first step also includes a further sub-step, represented by FIG. 9, which is performed before the second step of filling the mould with the material 11 of the bracelet strand. This sub-step consists in closing the aperture 120 of the fastening element 12 with a filling material. For example, this filling material may be a two-component silicone containing vinyl, silicic acid and aggregating materials, which has the advantage of polymerizing in a few minutes. For example, this material may be the product known under the trade name Plastiform™ F50 or Plastiform™ F85. The filling material is, for example, deposited by means of a metering gun, and is then immediately cured so as to form an obstacle 40 to any re-entry of material 11 during the second step within the aperture 120 of the fastening element 12.

After removal from the mould, the process comprises an intermediate step of removing the obstacle 40 formed by the filling material deposited in the aperture 120 of the fastening element 12, to free this aperture 120.

The other steps of the process remain identical to those described with reference to the first embodiment.

Figure 10:
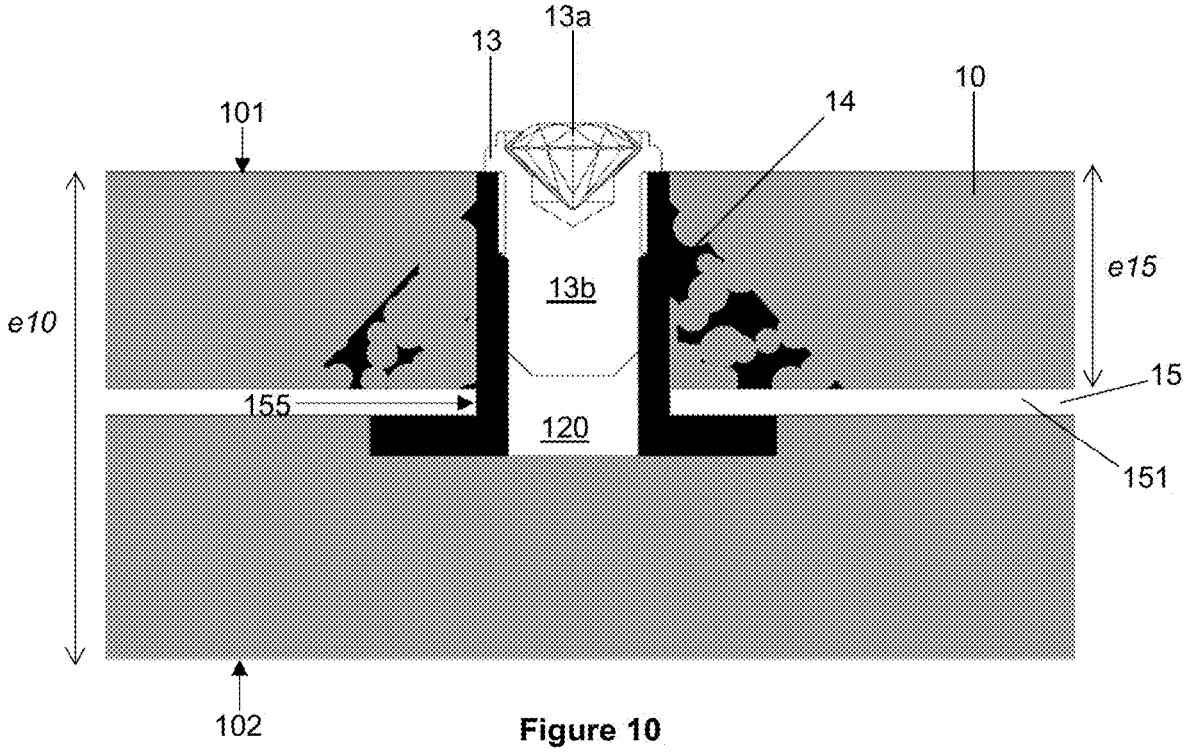
FIG. 10 represents an enlarged partial cross-sectional view of a bracelet strand according to a first implementation variant obtained via the process according to the second embodiment of the invention.

FIG. 10 illustrates, by way of example, a first implementation variant for the bracelet strand obtained via the process according to this second embodiment, in which the blade 151 forming the insert 15 is located substantially in the middle of the thickness of the bracelet strand. In a second variant, not shown, this blade might be positioned closer to the upper surface of the bracelet strand, as described in the context of the process according to the first embodiment for obtaining a bracelet strand according to the second variant. It should be noted that such a second bracelet strand variant also has the advantage of minimizing the size of the hooking element 14, in addition to simplifying the fastening element 12. In these embodiments, the resulting fastening element 12 is set into the insert 15.

In all embodiments, the fastening element 12 may be manufactured from any material that can withstand the temperatures associated with the process. Advantageously, this material is more particularly suitable for enabling the ornamental element 13 to be driven. By way of example, this material may be a metal alloy such as a copper alloy such as brass or $CuBe_2$, or even a stainless steel.

In the implementation variants described previously, the fastening elements are intended to receive ornamental elements. They may of course be intended to receive any other element, for example in order to fulfil a new function. For example, in a particular bracelet construction comprising a pin buckle, the apertures of the fastening elements could form a series of aligned apertures, intended to receive the pin and thus participate in adjusting the length of the bracelet. Such a construction would have the advantage of eliminating any deformation of these apertures intended to receive the pin, which are usually formed directly on the bracelet strand by cutting the material. A fastening element according to the invention may thus fulfil various functions, and there is therefore not necessarily a permanent fixing of a different element in a fastening element.

Moreover, as described previously, in all the implementation variants, a fastening element may be in the form of a ring, optionally comprising a seating. Such a seating has the advantage of locally limiting the bending of the strap strand around the fastening element. Needless to say, the invention is not limited to the form of the fastening elements as represented, which may take any other form depending on the functionality required. For example, a fastening element may be in the form of a cylindrical or frustoconical ring or any other shape, arranged around an axis, for example of annular shape in cross section to said axis. Preferentially, in all the implementation variants, the fastening element, in particular the ring acting as a fastening element, comprises a surface which is flush with the upper surface of the bracelet strand.

In the embodiments described, a fastening element is positioned in a mould by means of at least one guide element. Such a guide element may be in various forms. For example, it may be an element projecting in a certain direction into a cavity of the manufacturing mould, notably arranged symmetrically around an axis parallel to said direction, notably cylindrical or frustoconical in shape and/or circular in cross section to said axis.

Furthermore, in all the implementation variants, the fastening element may or may not be combined with a hooking element, the latter being provided to maximize the anchoring of the material constituting the envelope of the component around the fastening element. Preferentially, a hooking element may be made of aluminium or titanium foam.

As described previously, an ornamental element may be in the form of an assembly such as a stone set within a bezel. The stone may, for example, be a natural stone such as a precious stone (diamond, ruby, sapphire, emerald) or a fine stone, for instance jasper. The stone may also be organic, and may, for example, be in the form of a pearl or mother-of-pearl. The bezel may, for example, be manufactured from a precious alloy such as a gold-based alloy.

Alternatively, the ornamental element may be made in one piece. For example, it may be manufactured from a ceramic, for example a ceramic mainly or predominantly composed of zirconia, or alumina, or silicon nitride, or boron carbide, or aluminium nitride. Alternatively, the ornamental element may also be made of a composite material such as an alumina-zirconia ZTA/ATZ composite. Alternatively also, the ornamental element may be made of a precious metal alloy such as a gold or platinum based alloy. Moreover, it may comprise a pattern.

Moreover, the insert notably advantageously fulfils a reinforcing function. Moreover, this insert has been described as being in the form of a blade. Naturally, such a blade may occupy different surfaces, extend substantially continuously over a significant dimension of a bracelet strand, for example over at least 50% or even 70% of its length, or, as a variant, take on a restricted dimension, being located solely at the fastening element(s). Furthermore, the invention is not limited to a blade-shaped insert.

The invention also relates to a timepiece, notably a wristwatch, comprising such a bracelet strand.

The invention claimed is:

1. A bracelet strand comprising a material, wherein the bracelet strand comprises:

an insert extending along a main longitudinal direction of the bracelet strand, the insert having an upper surface and a lower surface, and at least one fastening element, resting on the insert or being set in the insert, the insert and the at least one fastening element being overmoulded by the material including by being at least partially enveloped and set by the material, wherein the at least one fastening element extends over an entire thickness at least from the upper surface of the insert to an upper surface of the bracelet strand, and wherein the at least one fastening element has a shape of a ring of cylindrical or frustoconical shape; and/or the at least one fastening element has an annular cross-sectional shape; and/or the at least one fastening element has a shape of a seating ring.

2. The bracelet strand according to claim 1, wherein the insert has a shape of a blade, and wherein the insert comprises two setting devices respectively at each of two ends thereof, in order to connect the bracelet strand (i) to a watch case and on (ii) to another bracelet strand.

3. The bracelet strand according to claim 2, wherein the insert extends substantially parallel to opposite upper and lower surfaces of the bracelet strand, and the insert is positioned equidistant from the upper and lower surfaces or closer to the upper surface.

4. The bracelet strand according to claim 1, wherein the at least one fastening element extends along a main direction perpendicular to the upper surface of the bracelet strand.

5. The bracelet strand according to claim 1, wherein the at least one fastening element comprises a textured surface and/or a surface comprising a binding primer on which the material is overmoulded; and/or the at least one fastening element comprises a hooking element arranged at least partially around the fastening element.

6. The bracelet strand according to claim 1, wherein the material is a thermoplastic or thermosetting polymer or an elastomer or elastomer-based material; and/or the at least one fastening element is made of metal or of metal alloy.

7. The bracelet strand according to claim 1, comprising an ornamental element set into the at least one fastening element; and/or several fastening elements forming fastening portions of the bracelet strand.

8. A timepiece comprising at least one bracelet strand according to claim 1.

9. The timepiece according to claim 8, which is a wristwatch.

10. A process for manufacturing a bracelet strand, the method comprising:

positioning an insert within a cavity of a manufacturing mould;

positioning at least one fastening element on the insert using at least one guide element;

filling the manufacturing mould with a material so as to overmould by at least partially enveloping and setting the insert and the at least one fastening element in the material;

removing the bracelet strand from the manufacturing mould, the bracelet strand being at least partly formed by the material, the insert and the at least one fastening element, so as to obtain the bracelet strand according to claim 1.

11. The process according to claim 10, wherein the positioning the at least one fastening element on the insert comprises:

setting an included guide element in an aperture of the insert, or providing an insert comprising a projection forming a guide element; and positioning the at least one fastening element around the guide element.

12. The process according to claim 10, wherein the positioning the at least one fastening element on the insert comprises inserting the at least one fastening element in an aperture forming a guide element of the insert.

13. The process according to claim 12, wherein the at least one fastening element comprises a central aperture and wherein the process comprises an intermediate closing of the central aperture with a filling material, before implementing the filling the manufacturing mould with a material so that the material does not occupy the central aperture, and then removing the filling material.

14. The process according to claim 10, wherein the insert extends in a longitudinal direction of the bracelet strand and comprises a positioning or setting device on each of two ends thereof, by which the insert is positioned or set within the cavity of the manufacturing mould, substantially parallel to opposite upper and lower surfaces of the cavity of the manufacturing mould, and equidistant from the upper and lower surfaces or closer to the upper surface.

15. The process according to claim 10, wherein the at least one guide element is an element projecting in one direction into the cavity of the manufacturing mould, and wherein the at least one fastening element extends around the at least one guide element.

16. The process according to claim 10, comprising an intermediate texturing and/or adding a binding primer to a surface of the at least one fastening element intended to receive the overmoulding of the material; and/or an intermediate adding a hooking element arranged at least partially around the at least one fastening element.

17. The process according to claim 10, wherein the filling the manufacturing mould with a material includes pressure injection of the material into a cavity of the manufacturing mould, or compression moulding.

18. The process according to claim 10, comprising removing the guide element after the removing of the bracelet strand from the mould.

19. The process according to claim 10, comprising setting an ornamental element into the at least one fastening element.

20. A bracelet strand comprising a material, wherein the bracelet strand comprises:

an insert extending along a main longitudinal direction of the bracelet strand, the insert having an upper surface and a lower surface, and at least one fastening element, resting on the insert or being set in the insert, the insert and the at least one fastening element being overmoulded by the material including by being at least partially enveloped and set by the material, wherein the at least one fastening element extends over an entire thickness at least from the upper surface of the insert to an upper surface of the bracelet strand, and wherein the insert has a shape of a blade, and wherein the insert comprises two setting devices respectively at each of two ends thereof, in order to connect the bracelet strand (i) to a watch case and on (ii) to another bracelet strand.

21. The bracelet strand according to claim 20, wherein the insert extends substantially parallel to opposite upper and lower surfaces of the bracelet strand, and the insert is positioned equidistant from the upper and lower surfaces or closer to the upper surface.

22. A timepiece comprising a bracelet strand comprising a material, wherein the bracelet strand comprises:

an insert extending along a main longitudinal direction of the bracelet strand, the insert having an upper surface and a lower surface, and at least one fastening element, resting on the insert or being set in the insert, the insert and the at least one fastening element being overmoulded by the material including by being at least partially enveloped and set by the material, wherein the at least one fastening element extends over an entire thickness at least from the upper surface of the insert to an upper surface of the bracelet strand.

23. The timepiece according to claim 22, which is a wristwatch.

* * * * *